US006513565B1

(12) United States Patent
Rupel et al.

(10) Patent No.: US 6,513,565 B1
(45) Date of Patent: Feb. 4, 2003

(54) LIGHT CONTROLLING CELLULAR SHADE AND METHOD OF MAKING SAME

(75) Inventors: John D. Rupel, Verona, WI (US); John R. Thomson, Oconto Falls, WI (US); Larry P. Belongia, Oconto, WI (US)

(73) Assignee: Springs Window Fashions LP, Fort Mill, SC (US)

( * ) Notice: Subject to any disclaimer, the term of this patent is extended or adjusted under 35 U.S.C. 154(b) by 0 days.

(21) Appl. No.: 09/451,555

(22) Filed: Dec. 1, 1999

Related U.S. Application Data

(60) Provisional application No. 60/110,392, filed on Dec. 1, 1998.

(51) Int. Cl.[7] ..... E06B 9/06

(52) U.S. Cl. ..... 160/84.05; 156/197; 428/116; 428/118

(58) Field of Search ..... 160/84.05, 84.01, 160/84.04, 89; 428/116, 118; 156/193, 197

(56) References Cited

U.S. PATENT DOCUMENTS

| | | | | |
|---|---|---|---|---|
| 2,201,356 A | | 5/1940 | Terrell | 156/16 |
| 3,963,549 A | | 6/1976 | Rasmussen | 156/193 |
| 4,288,485 A | | 9/1981 | Suominen | 428/116 |
| 4,346,132 A | | 8/1982 | Cheng et al. | 428/76 |
| 4,603,072 A | | 7/1986 | Colson | 428/116 |
| 4,625,786 A | | 12/1986 | Carter et al. | 160/84 R |
| 4,631,217 A | | 12/1986 | Anderson | 428/118 |
| 4,677,012 A | | 6/1987 | Anderson | 428/116 |
| 5,078,195 A | * | 1/1992 | Schon | |
| 5,160,563 A | | 11/1992 | Kutchmarek et al. | 156/204 |
| 5,313,999 A | | 5/1994 | Colson et al. | 160/121.1 |
| 5,339,882 A | * | 8/1994 | Judkins | |
| 5,394,922 A | | 3/1995 | Colson et al. | 160/121.1 |
| 5,454,414 A | | 10/1995 | Colson et al. | 160/84.02 |
| 5,664,613 A | | 9/1997 | Jelic | 160/84.05 |
| 5,701,940 A | * | 12/1997 | Ford et al. | |
| 5,702,552 A | | 12/1997 | Kutchmarek et al. | 156/197 |
| 6,068,039 A | * | 5/2000 | Judkins | |

FOREIGN PATENT DOCUMENTS

| | | | |
|---|---|---|---|
| GB | 756270 | * | 9/1956 |

* cited by examiner

*Primary Examiner*—Blair M. Johnson
(74) *Attorney, Agent, or Firm*—Lerner, David, Littenberg, Krumholz & Mentlik, LLP

(57) ABSTRACT

A light control window covering includes a plurality of cells attached one atop the other. Each cell has a substantially opaque top strip at the top of the cell and a substantially opaque bottom strip at the bottom of the cell. Each cell also includes a substantially transparent front sheer member extending vertically at a front of the window covering having an upper end folded inwardly toward a front edge of the top strip and a lower end folded inwardly toward a front edge of the bottom strip, and a substantially transparent rear sheer member extending vertically at a rear of the window covering having an upper end folded inwardly toward a rear edge of the top strip and a lower end folded inwardly toward a rear edge of the second strip. An individual cell is formed by flexibly connecting the end portions of the front and rear sheer members to adjacent ends of the top and bottom strips to form a generally rectangular-shaped loop. The window covering includes an operating element in contact with the plurality of cells for causing relative vertical movement of the front and rear sheer members which, in turn, causes the top and bottom substantially opaque strips to rotate between a first substantially horizontal position which allows light to flow through the sheer members and a second position in which the opaque strips at least partially obstruct the flow of light through the sheer members. In certain embodiments, the ends of the front and rear sheer strips overlap the ends of the opaque strips and the adhesive is provided between the overlapped ends. Also disclosed are preferred methods of making light controlling window coverings.

32 Claims, 17 Drawing Sheets

LIGHT CONTROLLING CELLULAR SHADE AND METHOD OF MAKING SAME

CROSS-REFERENCE TO RELATED APPLICATIONS

The present application claims benefit under 35 U.S.C. Section 120 of commonly assigned U.S. provisional application No. 60/110,392 filed Dec. 1, 1998, the disclosure of which is hereby incorporated by reference herein.

BACKGROUND OF THE INVENTION

The present invention relates to window coverings and more specifically relates to window coverings having cells adapted for selectively controlling the amount of light passing through the window covering and to methods of making such window coverings.

For many years, window coverings have been used to at least partially cover a window opening and selectively close off the view therethrough. One well-known type of window covering is a venetian blind having a large number of elongated slats. In order to improve the energy efficiency of buildings and to decrease the amount of heat escaping through window openings, cellular shades were developed that replaced the slats of a venetian blind with a plurality of air trapping cells. The air trapping cells are typically formed by shaping or folding a fabric material, such as cloth, into a plurality of elongated loops. The elongated loops are then connected together and comprise the body of the window covering. Thus, a typical cellular shade includes a horizontally arranged head rail, a horizontally arranged bottom rail remote therefrom, and a plurality of cells there between being interconnected one atop of the other.

In a top pulling shade, the lowermost cell in the window covering is received in or attached to the bottom rail and the bottom rail is interconnected with the cells and the head rail by at least one lifting cord. When the lifting cord is pulled, the bottom rail assembly attached to the cord moves in an upward direction toward the head rail, thereby causing the individual cells to collapse into substantially flat sections. During upward movement of the bottom rail, the individual cells preferably collapse in series from the lowermost cell to the uppermost cell. When the window covering is fully opened, all of the cells are collapsed to provide a final structure having a bottom rail assembly, a stack of collapsed cells thereon and a head rail assembly disposed at the top of the window opening. In order to close the cellular shade, the lift cord is manipulated so that the bottom rail falls or moves away from the head rail, thereby carrying the stack of collapsed cells downward. During downward movement of the bottom rail, the uppermost cell of the window covering will open first and the remaining cells will open in series from the uppermost cell to the lowermost cell. If the bottom rail is stopped or secured in place between the fully opened position and the closed position, the window covering will have a series of cells (adjacent the top rail) that are open and a series of cells (adjacent the bottom rail) that are collapsed or folded.

The prior art discloses various methods and apparatus for forming an expandable cellular shade for window openings. U.S. Pat. Nos. 3,963,549 and 4,603,072, disclose methods of making a cellular structure from a plurality of separate tubes or separate strips that are folded into a tubular configuration, and adhered together, one on top of the other, to form longitudinally extending cells. U.S. Pat. Nos. 4,288,485 and 4,346,132 disclose methods of making a cellular structure from a plurality of sheets that are stacked and adhered together along spaced bands to form a plurality of cells between adjacent sheets. U.S. Pat. Nos. 4,631,217 and 4,677,012 disclose a method of making a cellular structure from a plurality of separate sheets that are longitudinally folded and adhered together such that each sheet forms a part of two adjacent cells. U.S. Pat. Nos. 2,201,356 and 4,625,786 disclose forming a cellular structure from two folded sheets disposed at opposite sides of a shade and connected together at spaced locations.

Commonly assigned U.S. Pat. No. 5,160,563, the disclosure of which is hereby incorporated by reference herein, discloses a method and apparatus for making a pleated expandable and collapsible multi-cell window covering. A web of material is accordion folded widthwise to form a series of web panels united in alternate succession along first and second creased folds disposed at respective first and second sides of the web. Successive panels are advanced in an unfolded condition lengthwise of the web through an adhesive applying zone to an inlet end of a refold stack and adhesive is applied to each web panel, in a band parallel to and spaced from the associated creased fold with a preceding panel. The web panels having adhesive applied thereto are refolded in succession along the associated creased fold with a preceding panel onto the inlet end of the refold stack. The band of adhesive is applied at the second side of the web to each panel that joined along a first creased fold to a preceding web panel and the band of adhesive is applied at the first side of the web to each panel that is joined along a second creased fold to a preceding panel.

In recent years, light control cellular shades have become increasingly common, particularly those which employ one or two continuous sheets of sheer material to form the front or rear of the shade structure. For example, U.S. Pat. Nos. 5,313,999, 5,394,922 and 5,454,414 disclose light control shades in which both the front and rear sheer portions are made from a single sheet of sheer material. U.S. Pat. No. 5,664,613 discloses a light control shade which includes one continuous sheet of sheer material and a series of strips attached to the sheet having opaque and sheer portions.

Commonly assigned U.S. Pat. No. 5,702,552 to Kutchmarek et al., the disclosure of which is hereby incorporated by reference herein, discloses a method and apparatus for forming a pleated cellular shade product from a single web of material, whereby the shade has different physical characteristics on opposite sides thereof. In one embodiment, a web is provided having alternate first and second stripe areas extending across the web at predetermined intervals. The first stripes have a light transmissive character that differs from the light transmissive character of the second stripes. The web is folded in a first direction along a first fold line intermediate side edges of the first stripe area and in a second direction along a second fold line intermediate side edges of each second stripe area to form a plurality of sidewise adjacent panels, serially united in alternate succession along respective first and second fold lines. After the web has been folded, the first stripes provide the desired light transmissive characteristics on one side of the shade and the second stripes provide different light transmissive characteristics on the opposite side of the shade, without adversely affecting the appearance of the shade product. Thus, the shade product may be formed with different colors or textures at opposite sides or with a light reflection and/or absorbent surface on one side or the other for enhanced insulating characteristics.

SUMMARY OF THE INVENTION

In accordance with one preferred embodiment of the present invention, a light controlling window covering includes a plurality of elongated cells attached one atop the other. Each cell of the window covering is generally rectangular when view in cross-section and preferably includes a substantially opaque top strip at the top of the cell and a substantially opaque bottom strip at the bottom of the cell. As used herein, the term substantially opaque or opaque means that the material allows no or very little light to pass therethrough. One of the opaque strips may be colored or darkened and the other opaque strip may be white or a light color close to white. Each cell also preferably includes a front sheer strip extending vertically at a front of the window covering and a rear sheer strip extending vertically at a rear of said window covering.

In order to assemble an individual cell, an upper end of the front sheer strip is preferably folded inwardly toward a front edge of the top opaque strip and a lower end of the front sheer strip is folded inwardly toward a front edge of the bottom strip. In a similar fashion, an upper end of the rear sheer strip may be folded inwardly toward a rear edge of the top opaque strip and a lower end of the rear strip may be folded inwardly toward a rear edge of the second opaque strip. The opposed ends of the opaque top and bottom strips and the sheer strips are preferably connected together using an adhesive swirl. The adhesive swirl is preferably an elongated strand of an adhesive material that reciprocates back and forth between the opposed edges of adjacent strips. The adhesive swirl extends the length of the opposed edges and when cured forms a flexible joint between adjacent strips. The adhesive swirl preferably spans a relatively small gap between the opposed edges of the two opaque strips and the two sheer strips. After the adhesive swirl cures, the adhesive swirl provides a flexible hinge that enables the strips to be formed into a continuous loop.

In other preferred embodiments, the ends of the sheer strips overlap the ends of the opaque strips and an adhesive is disposed between the overlapped ends of the strips. Thus, in this embodiment there is no gap between opposed edges of the strips when they are arranged side-by-side.

The two sheer strips generally form the side walls of a cell and the two opaque strips generally form the top and bottom walls of the cell. In certain embodiments, the two sheer side walls may have one or more creases formed therein for enabling the cells to expand and/or collapse when the window covering is lowered to cover the window and retracted to allow a view through the window.

The front and rear sheer members are preferably made from an at least partially transparent fabric that allows substantial amounts of light to pass between the front and rear walls of each cell. The opaque strips and the sheer strips are typically made of a flexible fabric material.

After a plurality of individual cells have been formed, the cells may be stacked atop one another and connected for making a complete window shade. The cells may be connected together by depositing relatively thick beads of an adhesive material at the end portions of the front and rear sheer members. The adhesive beads are preferably placed adjacent the ends of the top wall of each cell.

The window covering preferably includes an operating element in contact with the cells of the window covering for causing relative vertical movement of the front and rear walls (i.e., sheer strips). During actuation of the operating element, relative vertical movement between the front and rear sheer strips causes the substantially opaque top and bottom strips to rotate between a first substantially horizontal position and a second non-horizontal position. In the first substantially horizontal position, the substantially opaque top and bottom strips allow substantial amounts of light to flow through the window covering, i.e., between the front and rear sheer walls. In the second non-horizontal position, the substantially opaque top and bottom strips at least partially reduce the amount of light passing through the window covering, i.e., at least partially obstruct the light flowing through the front and rear sheer walls of each cell.

The window covering also preferably includes a head rail assembly attached to an uppermost cell of the plurality of cells and a bottom rail assembly attached to a lowermost cell of the plurality of cells. The operating element also preferably includes one or more lift cords connected to the head rail and the bottom rail for raising and lowering one of the head rail and bottom rail assemblies relative to the other of the head rail and bottom rail assemblies. The top and bottom walls of each cell preferably have at least one opening through which the one or more lift cords pass. In other preferred embodiments, the one or more lift cords may pass through the adhesive swirl connecting the ends of the sheer strips and the top and bottom opaque strips.

In still further embodiments, the window covering may include a separate layer of fabric sandwiched between adjacent cells and extending toward a rear side of the window covering. Each of the rearwardly extending layers of fabric desirably includes an aperture through which the one or more lift cords may pass.

In another preferred embodiment of the present invention, a light controlling window covering includes a plurality of cells attached one atop the other. In this particular embodiment, each cell includes a substantially opaque top strip at the top of the cell, a substantially opaque bottom strip at the bottom of the cell, a substantially transparent front sheer strip extending vertically at a front of the window covering and a substantially transparent rear sheer strip extending vertically at the rear of the window covering. The front sheer strip preferably has an upper end folded inwardly toward a front edge of the top strip and a lower end folded inwardly toward a front edge of the bottom strip. The rear sheer strip preferably has an upper end folded inwardly toward a rear edge of the top strip and a lower end folded inwardly toward a rear edge of the bottom strip. The front and rear sheer strips have end portions that are flexibly connected to adjacent ends of the top and bottom opaque strips to form a generally rectangular-shaped loop. The window covering also includes an operating element in contact with the cells for causing relative vertical movement of the front and rear sheer members, wherein relative vertical movement between the front and rear sheer members causes the top and bottom strips to rotate between a first substantially horizontal position which allows light to flow between the sheer strips and a second position in which the top and bottom opaque strips at least partially obstruct the flow of light through the sheer strips.

Further preferred embodiments of the present invention provide a method of making a light control window covering having a plurality of cells including providing first and second continuous webs of substantially opaque material, providing first and second continuous webs of sheer material adapted to permit light to pass therethrough, forming an individual cell by connecting a first end of the first sheer web to a first end of the first substantially opaque web, connecting the second end of the first substantially opaque web to a first end of the second sheer web, connecting the second end of the second sheer web to a first end of the second substantially opaque web and connecting the second end of the second substantially opaque web to the second end of the first sheer web to thereby form a continuous loop of material having alternating sheer and substantially opaque portions. The forming steps include applying an adhesive between the ends of the sheer strips and the substantially opaque strips to provide a flexible hinge between the sheer strips and the substantially opaque strips.

The loop is then formed into a generally rectangular configuration and the rectangularly configured loop of material is cut into sections having a predetermined length to provide a plurality of cells. The cells are then stacked and adhered, such as by applying adhesive beads adjacent the ends of the sheer strips, to form a continuous shade. After the cells have been adhered together, the substantially opaque strips of each cell form the top and bottom walls of the cell and are positioned adjacent to opaque strips of adjacent cells. The sheer strips are preferably positioned along the side walls of each cell, i.e., along the exterior of the window covering.

The cells described above may be formed using a tube folding machine having one or more unwind stands for supplying webs of the sheer and opaque strips. The tube folding machine preferably includes a stationery support surface for supporting the strips and a pulling mechanism for pulling the strips across the support surface. The machine may also includes a trimmer for cutting the strips of sheer and opaque material after the material has been configured in a side-by-side arrangement for being adhered together. The tube forming machine may includes one or more adhesive applicators for supplying the adhesive necessary for assembly the strips together.

The tube forming machine also preferably includes a folding horn which folds the sheer strips and opaque strips into a substantially rectangular shaped tube after the strips have been adhered together. After the strips have been folded into a tube, the folding horn preferably form creases in the side walls of the tube for collapsing the side walls. The tubes are then preferably forwarded to a stacking machine. The tube stacker is preferably located downstream of the folding horn and receives the recently formed tubes discharged from the folding horn. The tube stacker receives incoming tube from roll and adheres the incoming tube to the uppermost tube of a stack of tubes that have previously been adhered together. The tube stacker includes a registration guide that guides the incoming tube into engagement with the top tube of the stack. The stack preferably remains stationary and the registration guide reciprocates back and forth between a start position and an end position. As it moves to the start position, the registration guide captures the uppermost tube in the stack and brings it into engagement with the incoming tube. The stacking element includes an adhesive applicator for applying an adhesive to the top wall of the uppermost tube as the registration guide traverses the uppermost tube.

In another preferred embodiment, the window covering is not used to control light passing through a window opening. In this embodiment, the window covering is assembled substantially similar to the steps described above, however, the cells do not include any sheer strips. As a result, the cells are substantially opaque at all times so that little or no light may pass through the shade when the shade is covering the window opening.

DETAILED DESCRIPTION OF PREFERRED EMBODIMENTS

Figure 1:
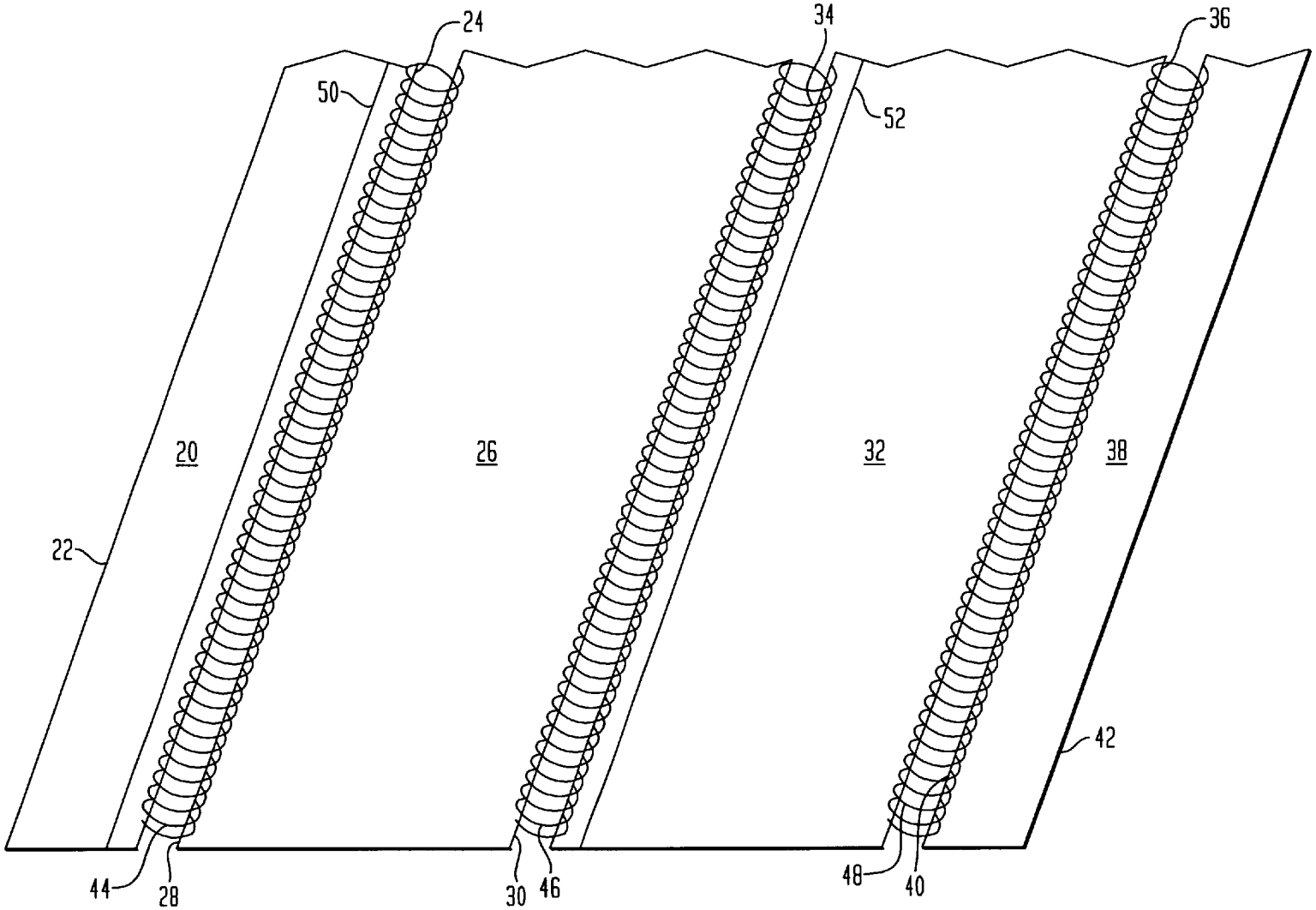
FIG. 1 shows a perspective view of one stage of a method of making a light controlling cellular shade, in accordance with certain preferred embodiments of the present invention.
Figure 2:
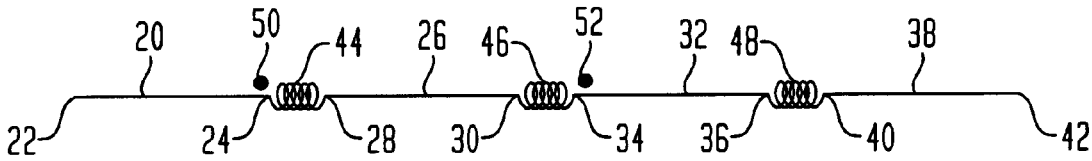
FIG. 2 shows an end view of the cellular shade subassembly shown in FIG. 1.

FIGS. 1–7 show a method of making a light controlling cellular shade having a plurality of cells in accordance with certain preferred embodiments of the present invention. Referring to FIGS. 1 and 2, each individual cell of the cellular shade includes four separate strips of material: a first strip 20 of sheer or substantially transparent material having a first lateral edge 22 and a second lateral edge 24; a first strip of a substantially opaque material 26 having a first lateral edge 28 and a second lateral edge 30; a second strip of sheer material 32 having a first lateral edge 34 and a second lateral edge 36 and a second strip of substantially opaque material 38 having a first lateral edge 40 and a second lateral edge 42. The sheer strips 20 and 32 and opaque strips 26 and 38 are generally rectangular in shape and have respective longitudinal axes that extend in directions substantially parallel to the lateral edges thereof. In certain preferred embodiments, the first opaque strip 26 includes a colored material, such as a dark fabric, and the second opaque strip 38 includes a material that is substantially white or near white. The opaque strips 26 and 38 are preferably completely or substantially opaque so that little or no light may pass therethrough, however, in other preferred embodiments the opaque strips may be partially transparent so that a limited amount of light may pass therethrough. The opaque strips typically comprise a soft material that does not have sufficient structural integrity to support its own weight.

In order to assemble the two sheer strips and the two opaque strips into an individual cell, the strips are fed from a continuous web and arranged in the configuration shown in FIGS. 1 and 2. After the strips are properly configured, three separate areas of adhesive swirl are applied between the lateral edges of the four strips. In the particular embodiment shown in FIGS. 1 and 2, a first adhesive swirl 44 is provided between the second lateral edge 24 of the first sheer strip 20 and the first lateral edge 28 of the first opaque strip 26. Next, a second adhesive swirl 46 is provided between the second lateral edge 30 of the first opaque strip 26 and the first lateral edge 34 of the second sheer strip 32. Finally, a third adhesive swirl 48 is provided between the second lateral edge 36 of the second sheer strip 32 and the first lateral edge 40 of the second opaque strip 38. The three adhesive swirls 44, 46 and 48 preferably include strands of liquid adhesive that traverses back and forth, in a reciprocating pattern, between the oppose lateral edges of the strips so as to adhere the opposed edges to one another. The liquid adhesive swirl is then preferably cured, such as by exposing the adhesive to air, to provide a compliant substance that secures the opposing edges of the strips together and that enables the strips to flex relative to one another.

Figure 3:
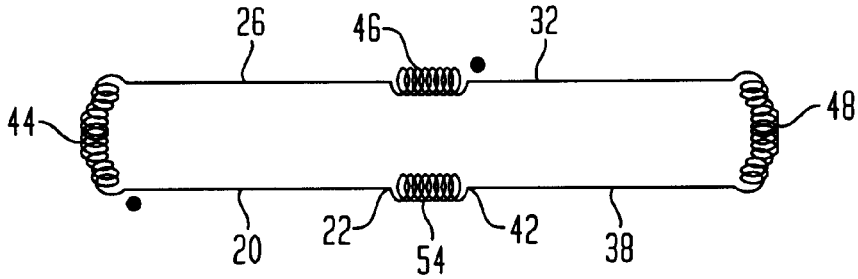
FIG. 3 shows an end view of the cellular shade subassembly of FIGS. 1 and 2 during a further stage of the assembly process.

After the three adhesive swirls have been applied between the strips 20, 26, 32 and 38 to flexibly connect the strips together, first and second relatively thick beads of adhesive 50 and 52 are applied adjacent the second edge 24 of the first sheer strip 20 and the first edge 34 of the second sheer strip 32. Referring to FIG. 3, after the three adhesive swirls 44, 46 and 48 and the adhesive beads 50 and 52 have been applied as set forth above, the first sheer strip 20 and the second opaque strip 38 are folded inwardly toward one another and a fourth adhesive swirl 54 is applied to the second lateral edge 42 of the second opaque strip 38 and the first lateral edge 22 of the first sheer strip 20 so as to flexibly join the second opaque strip 38 and the first sheer strip 20. The individual cell shown in FIG. 3 comprises the two opaque strips 26 and 38 and the two sheer strips 20 and 32 connected together in a continuous loop. As will be set forth in further detail below (FIG. 4A), the two opaque strips will form the respective top and bottom walls of an individual cell and the two sheer strips will generally form side walls of an individual cell. However, small portions of the two sheer strips may also form part of the top and bottom walls of the cell.

Figure 4A:
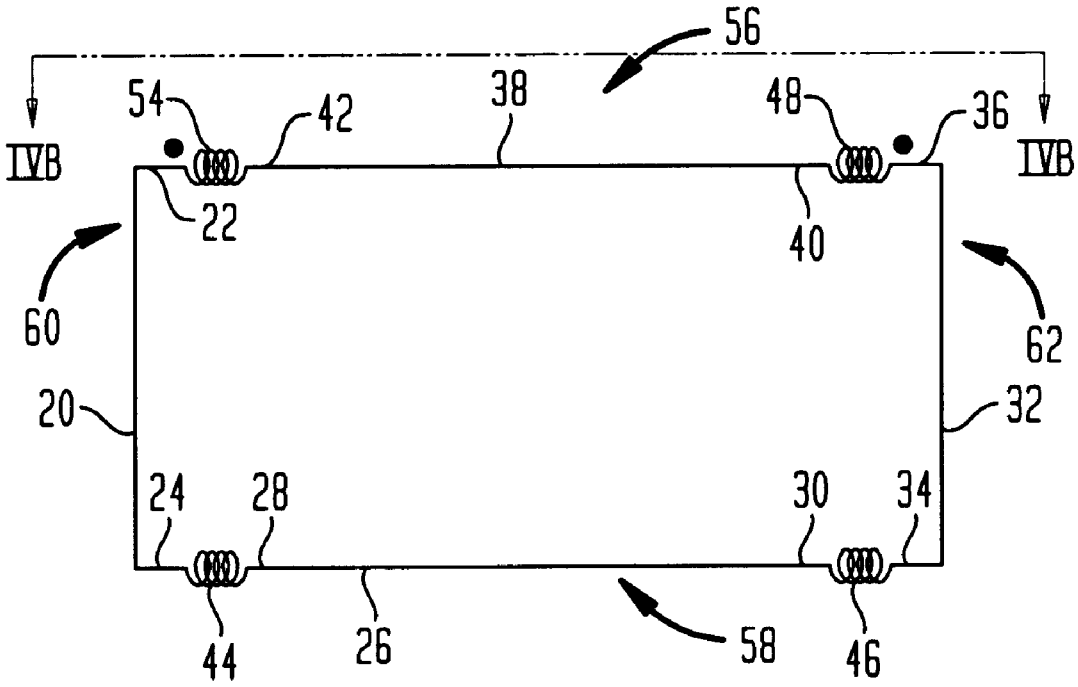
FIG. 4A shows an end view of the cellular shade subassembly of FIG. 3 during a further stage of the assembly process.
Figure 4B:
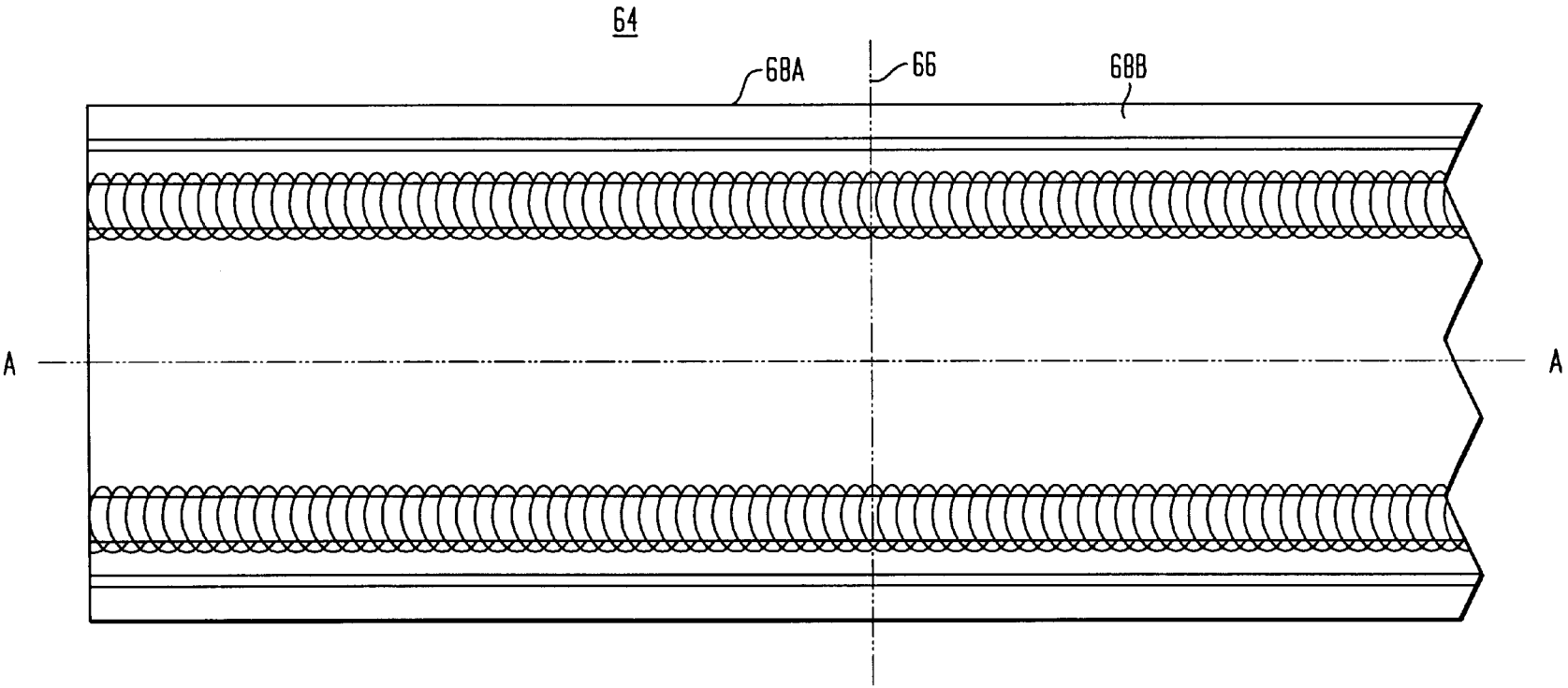
FIG. 4B shows a top view of the cellular shade subassembly of FIG. 4A taken along line IVB—IVB of FIG. 4A.

Referring to FIGS. 4A and 4B, the continuous loop comprising two opaque strips 26 and 38 and two sheer strips 20 and 32 is then configured into a rectangular arrangement whereby the second opaque strip 38 forms the top wall 56 of the cell and the first opaque strip 26 forms the bottom wall 58 of the cell. In addition, the first sheer strip 20 forms an interior or front wall 60 of the cell while the second sheer strip 32 forms an exterior or rear wall 62 of the cell. The cell preferably has a substantially rectangular shape when viewed in cross-section. A folding machine, such as that described in the aforementioned commonly assigned U.S. Pat. No. 5,702,552 may be used to make the folds in the walls of the cell.

Referring to FIG. 4A, the top wall 56 of the cell is formed by folding the first edge 22 of the first sheer strip 20 inwardly toward the second lateral edge 42 of the second opaque strip 38 and by folding the second edge 24 of the first sheer strip 20 inwardly toward the first edge 28 of the first opaque strip 26. In a similar fashion, the first lateral edge 34 of the second sheer strip 32 is folded inwardly toward the second edge 30 of the first opaque strip 26 and the second lateral edge 36 of the second sheer strip 32 is folded inwardly toward the first edge 40 of the second opaque strip 38. Thus, the two sheer strips 20 and 32 are folded such that central portions of the sheer strips extend in a substantially vertical direction to form the respective front and rear walls 60 and 62 of the cell, while relatively small portions of the sheer strips 20 and 32 (adjacent the lateral edges) are bent inwardly toward the first and second opaque strips 26 and 38.

As a result, the top and bottom walls 56 and 58 of each cell are formed by a portion of the exterior sheer strip 32, the first or second opaque strip 26 and 38, and a portion of the interior sheer strip 20. Specifically, the top wall 56 of the cell shown in FIG. 4A includes the second opaque strip 38, a portion of the first sheer strip 20 adjacent the first edge 22 thereof and a portion of the second sheer strip 32 adjacent the second edge 36 thereof. The bottom wall 58 of the cell includes the first opaque strip 26, a portion of the first sheer strip 20 adjacent the second edge 24 thereof and a portion of the second sheer strip 32 adjacent the first edge 34 thereof.

Referring to FIG. 4B, the cell subassembly preferably forms an elongated tube 64 that may be cut into shorter sections so that a plurality of stackable cells may be provided. The tube 64 is preferably cut along a cut line 66 that preferably extends in a direction that is substantially perpendicular to the longitudinal axis A-A of the tube 64. The tube is cut into smaller sections designated 68A and 68B to provide a plurality of individual cells that may be stacked atop one another and connected together, such as by using adhesive, to provide a cellular shade comprising a plurality of such cells. Although FIG. 4B shows only two cell sections 68A and 68B, it is contemplated that the tube 64 may be subdivided into a large number of smaller tube sections. In preferred embodiments, the lengths of the cut tube sections are greater than the widths of the cut tube sections.

Figure 5A:
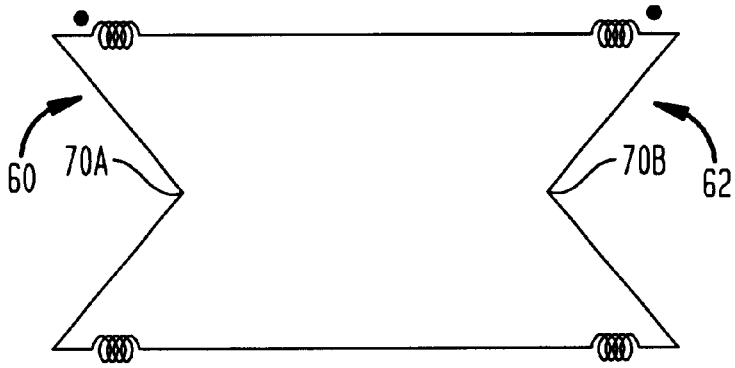
FIG. 5A shows an end view of the cell of FIG. 4A having inwardly directed creases formed in front and rear side walls, in accordance with certain preferred embodiments of the present invention.
Figure 5B:
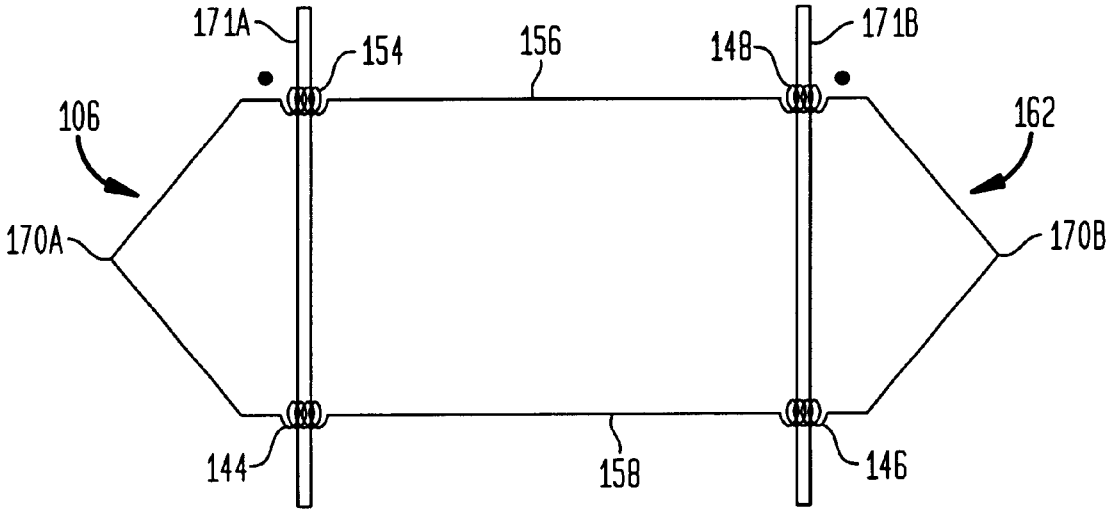
FIG. 5B shows an end view of the cell of FIG. 4A having outwardly directed creases, in accordance with certain preferred embodiments of the present invention.

Referring to FIG. 5A, the front and rear walls 60 and 62 of the cell are preferably folded to form inwardly directed creases 70A and 70B that enable each cell to expand when the window covering is lowered and to collapse, at least partially, when the window covering is raised. A conventional lift cord may be used to raise and lower the window covering. FIG. 5B shows another preferred embodiment whereby the front and rear walls 160 and 162 have outwardly directed creases 170A and 170B that enable the cells to expand and collapse. In certain preferred embodiments, lift cords 171A, 171B pass through the adhesive 144, 146, 148 and 154 connecting the ends of the sheer strips 170A, 170B and the top and bottom opaque strips 156, 158.

Figure 6:
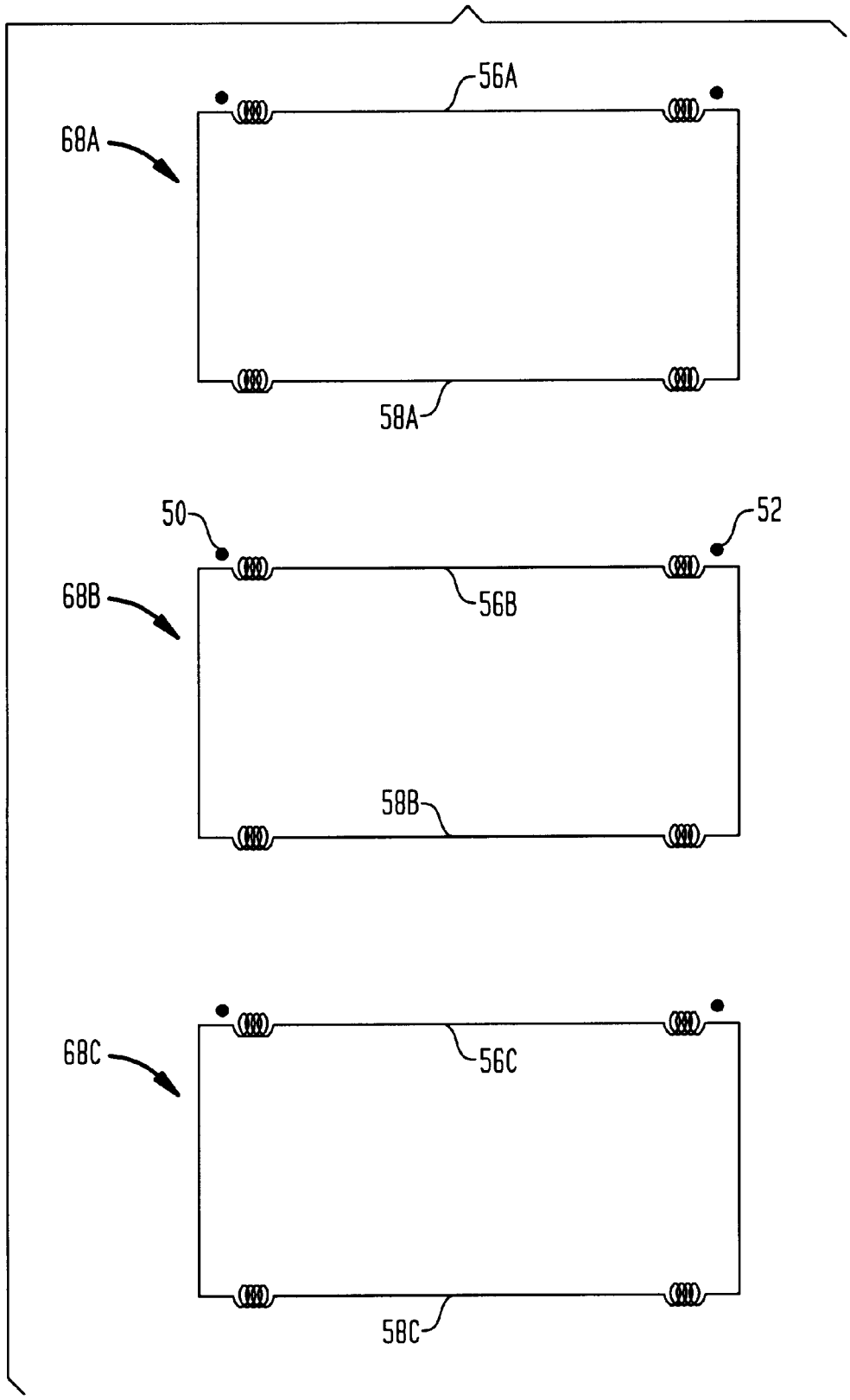
FIG. 6 shows a method of connecting together a plurality of the individual cells shown in FIG. 4A in accordance with certain preferred embodiments of the present invention.

Referring to FIG. 6, after a plurality of individual cells have been formed using the steps described above, the individual cells 68A, 68B, and 68C are stacked atop one another so that the bottom wall 58 of one cell abuts against the top wall 56 of another cell directly below. In FIG. 6, bottom wall 58A of top cell 68A abuts against top wall 56B of middle cell 68B and the bottom wall 58B of the middle cell 68B abuts against top wall 56C of bottom cell 68C. As a result, the beads of adhesive material 50 and 52 are sandwiched between opposing top and bottom walls of two adjacent cells for adhering the cells together. The process is continued until a cellular shade comprising a plurality of such cells is assembled. Each cellular shade preferably includes enough individual cells to completely cover a window opening when the shade is in an expanded state. Thus, the window covering assembled in accordance with the steps described above comprises a plurality of cells stacked and fused/adhered together so that the top wall of one four-sided or substantially rectangular cell is adhered to the bottom of an adjoining cell in a series making up the height of a window.

Figure 7:
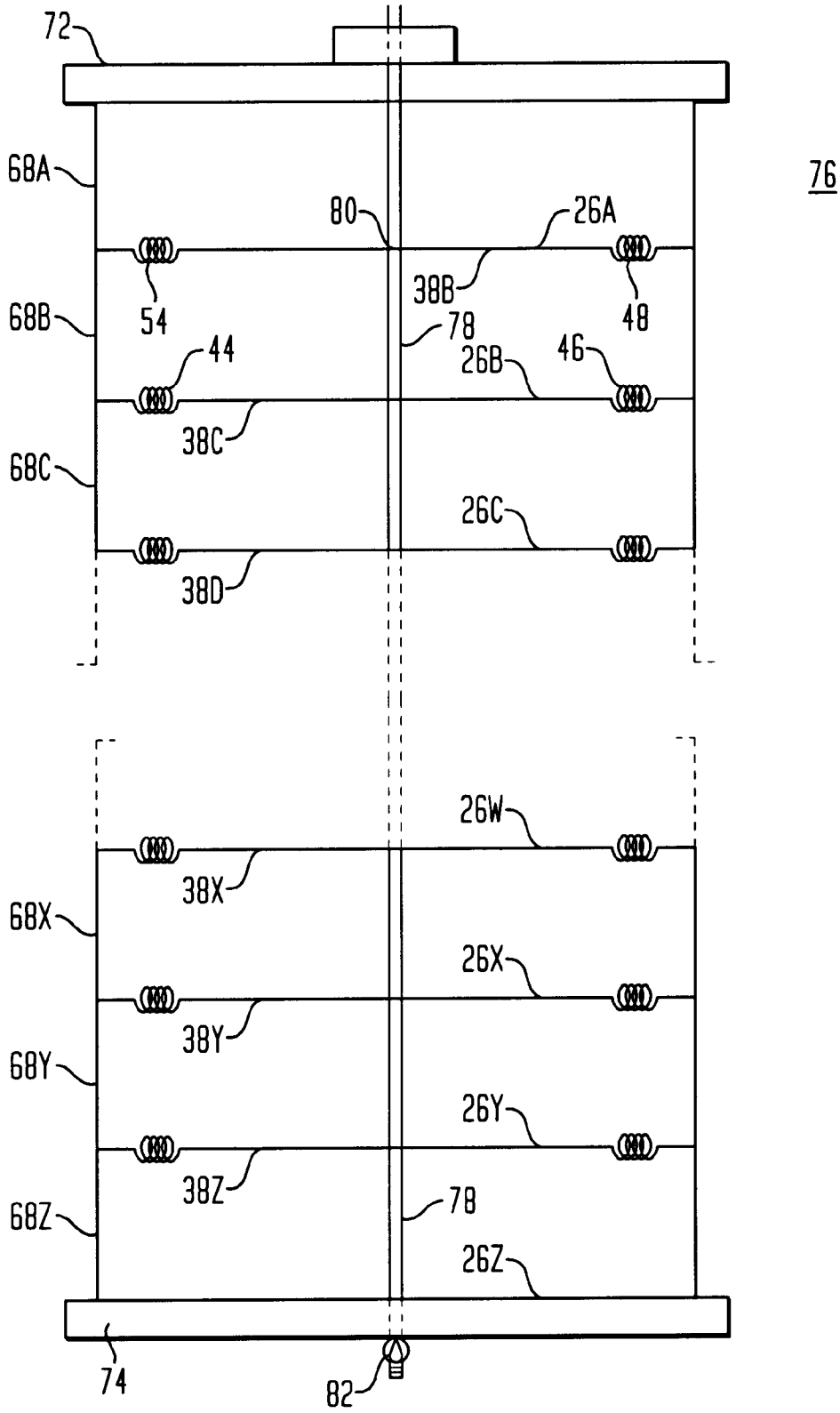
FIG. 7 shows an end view of a cellular shade manufactured in an expanded state, in accordance with certain preferred embodiments of the present invention.

Referring to FIG. 7, the uppermost cell 68A is preferably attached to a head rail 72 and the lowermost cell 68Z is preferably attached to a bottom rail 74. The plurality of cells generally extend in a direction that is substantially parallel to the longitudinal axes of the head rail and the bottom rail. The head and bottom rails 72 and 74 are relatively rigid, may comprise a polymer material, a metal or wood, and have lengths that correlate with the length of the cells or the width of the window opening.

The entire window covering 76 may be lifted by means of lift cords 78 anchored to the bottom rail 74 at the lowermost end of the window covering. Each opaque strip preferably has at least one aperture 80 through which the lift cords may pass. The openings 80 in the opaque strips 38 and 26 are preferably in substantial alignment with one another. The lift cord 78 is preferably threaded through the openings and is tied into a knot 82 after passing through the bottom rail 74. In operation, the lift cords 78 may be pulled for raising/retracting the window covering 76 or released for lowering/closing the window covering. The lift cords 78 may also be manipulated for positioning the window covering 76 at a position between the fully opened/retracted state and the fully closed/expanded state. In other preferred embodiments, the lift cords 78 may pass through one or more of the adhesive swirls used to flexibly connect the opaque strips and the sheer strips.

Figure 9:
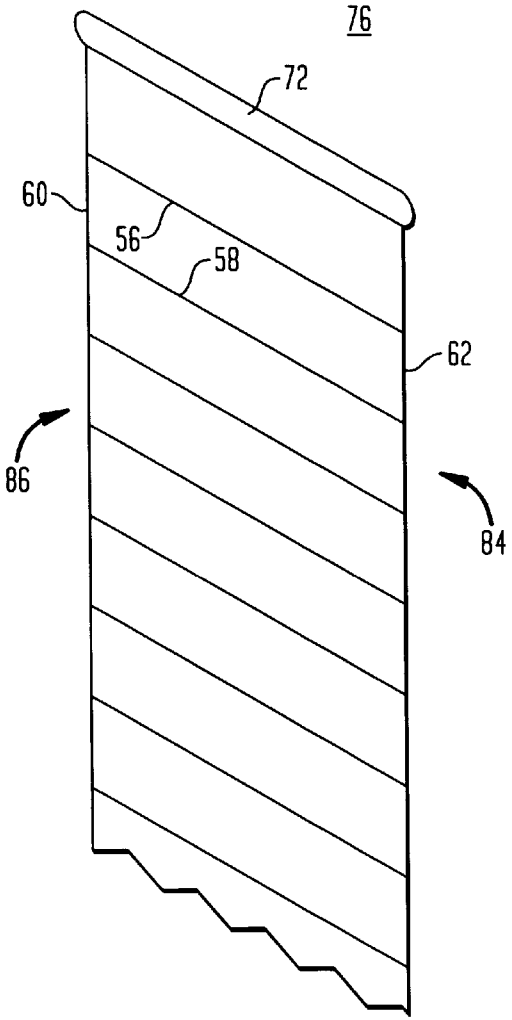
FIG. 9 shows the cellular shade of FIG. 8 with the top and bottom opaque strips of each cell in a non-horizontal orientation for at least partially blocking the amount of light passing through the shade, in accordance with certain preferred embodiments of the present invention.
Figure 8:
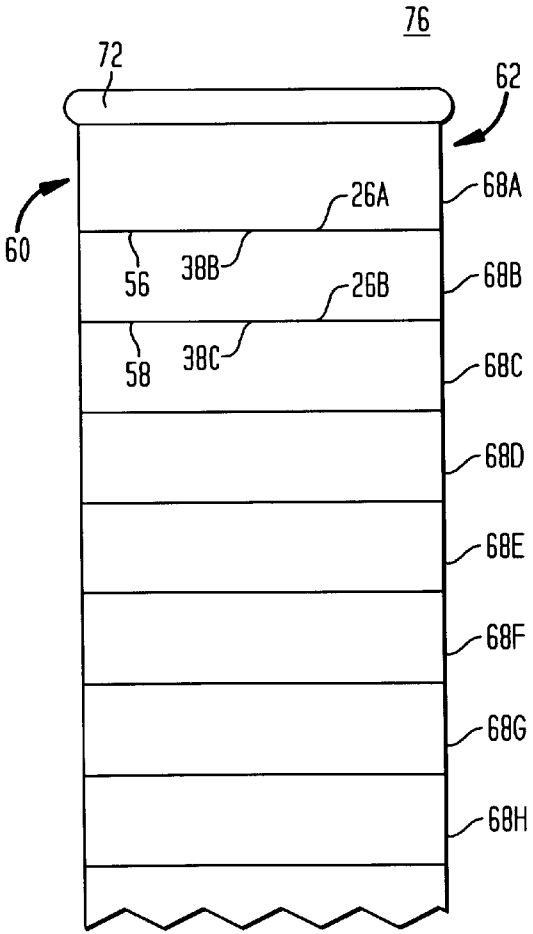
FIG. 8 shows the cellular shade of FIG. 7 with the top and bottom opaque strips in a substantially horizontal orientation for allowing light to pass through the shade, in accordance with certain preferred embodiments of the present invention.

After the window covering 76 has been assembled, the plurality of cells may be selectively rotated from the position shown in FIG. 8 to the position shown in FIG. 9 for controlling the amount of light passing through the shade. In the embodiment shown in FIGS. 8 and 9, a roller or rocking mechanism (not shown) is preferably connected to the head rail 72 and the cells 68 for controlling the amount of light transmitted through the window shade. The roller enables the front wall 60 of each cell 68 to be moved in a vertically direction relative to the rear wall 62 of the cell so that the opaque top and bottom walls 56 and 58 of each cell are rotated from the substantially horizontal position shown in FIG. 8 to the tilted or non-horizontal position shown in FIG. 9. In the configuration shown in FIG. 9, the opaque top and bottom walls 56 and 58 of each cell at least partially block the light passing through the rear and front sheer walls 62 and 60. As mentioned above, the top opaque wall may be "white" and will preferably face the rear of the window covering 84 (i.e., the street) to present a neutral look to passersby and the bottom wall will preferably face the front 86 of the window covering. While the rear/"white" side 84 and the front/"colored" side 86 are preferably substantially opaque, either or both may be of a material that admits some degree of light to pass from the rear side 84 of the window covering 76 to the front side 86 thereof.

Figure 10A:
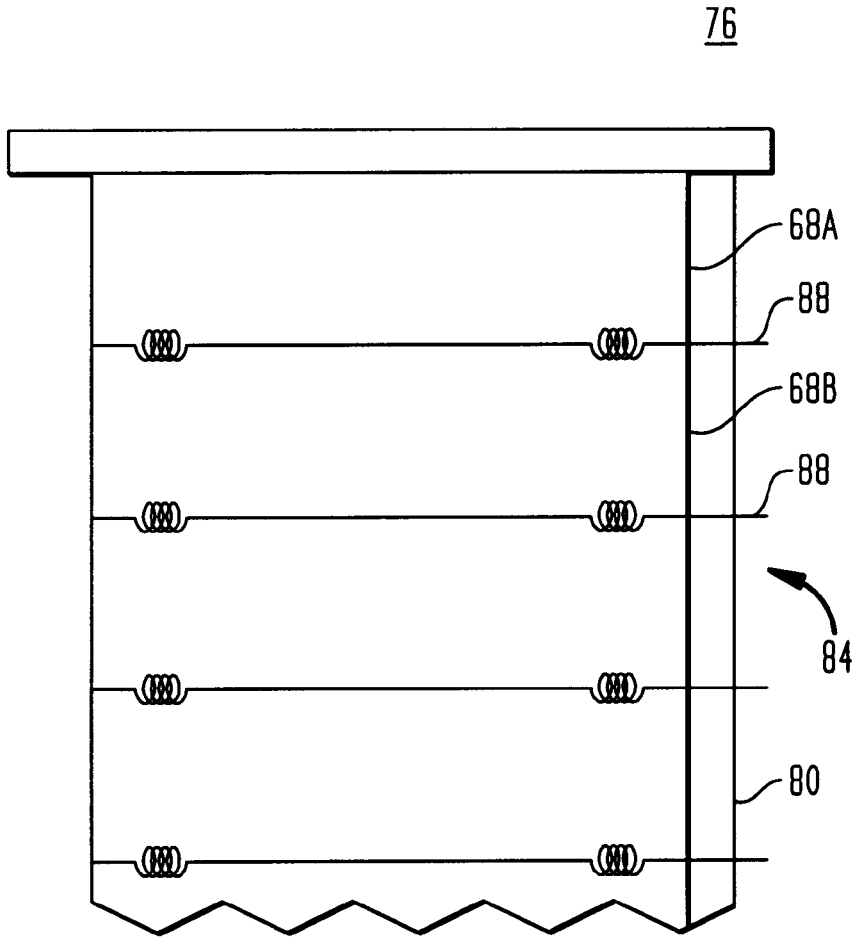
FIG. 10A shows an end view of a light controlling cellular shade, in accordance with further preferred embodiments of the present invention.
Figure 10B:
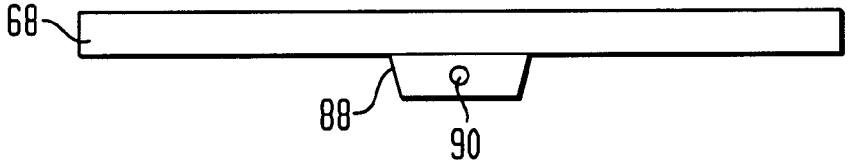
FIG. 10B shows a top view of the cellular shade of FIG. 10A taken along line XB—XB of FIG. 10A.

FIGS. 10A and 10B show another preferred embodiment whereby a relatively small, separate layer of fabric 88 is positioned between adjacent cells 68. The separate layers of fabric 88 preferably project toward the rear side 84 of the window covering 76. Referring to FIG. 10B, each fabric layer 88 preferably has an aperture 90 passing therethrough so that one or more lift cords 80 (FIG. 10A) may be threaded therethrough for raising and lowering the window covering 76.

In another preferred embodiment of the present invention, the window covering is not a light controlling window shade but is merely a cellular shade. In these embodiments, all of the strips that make up an individual cell are substantially opaque and none of the cells include sheer strips of material that allow substantial amounts of light to pass therethrough. In other preferred embodiments, some of the cells of a window covering may be made entirely of opaque material while other cells in the same window covering may be made of both opaque and sheer material.

Figure 11:
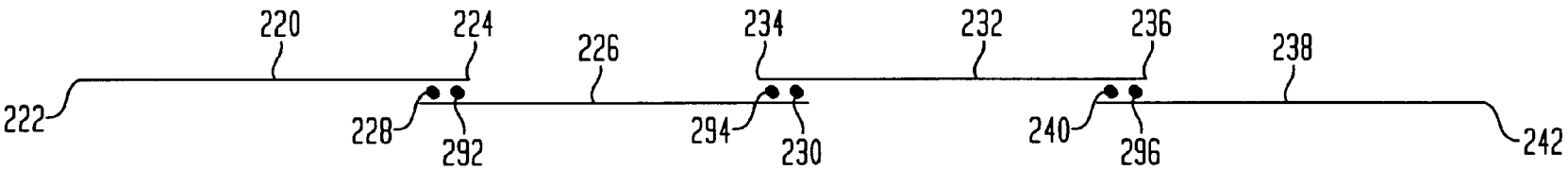
FIG. 11 shows a cross sectional view of a first stage of a method of making a light controlling cellular shade, in accordance with another preferred embodiment of the present invention.

FIGS. 11–14 shown another preferred method of making a light controlling cellular shade in accordance with certain preferred embodiments of the present invention. Referring to FIG. 11, four separate rolls of material are paid out from four distinct unwinding stands. The four rolls include a first sheer strip 220 having a first edge 222 and a second edge 224, a first opaque strip 226 having a first edge 228 and a second edge 230, a second sheer strip 232 having a first edge 234 and a second edge 236, and a second opaque strip 238 having a first edge 240 and a second edge 242. The sheer strips and the opaque strips are paid out so that their edges overlap one another. Specifically, the second edge 224 of the first sheer strip 220 overlaps the first edge 228 of the first opaque strip 226 and the first edge 234 of the second sheer strip 232 overlaps the second edge 230 of the first opaque strip 226. In addition, the second edge 236 of the second sheer strip 232 overlaps the first edge 240 of the second opaque strip 238. The present embodiment differs from the method of making a light controlling cellular shade set forth above in that with the present embodiment there are no gaps between the edges of the side-by-side strips.

The strips shown in FIG. 11 are then adhered together by applying an adhesive between the overlapping edges. In one embodiment, two beads 292 of adhesive are provided between the second edge 224 of the first sheer strip 220 and the first edge 228 of the first opaque strip 226. In addition, two beads 294 of adhesive are provided between the first edge 234 of the second sheer strip 232 and the second edge 230 of the first opaque strip 226. Finally, two beads of adhesive 296 are provided between the second edge 236 of the second sheer strip 232 and the first edge 240 of the second opaque strip 238. Although the embodiment in FIG. 11 shows two beads being applied between the overlapping edges, it is contemplated that a number of other methods for applying adhesive may be used for adhering the overlapping edges to one another. In addition, the FIG. 11 embodiment shows the edges of the sheer strips 220 and 232 overlying the edges of the opaque strips 226 and 238. In other preferred embodiments, the edges of the opaque strips may overlie on top of the edges of the sheer strips.

Figure 12:
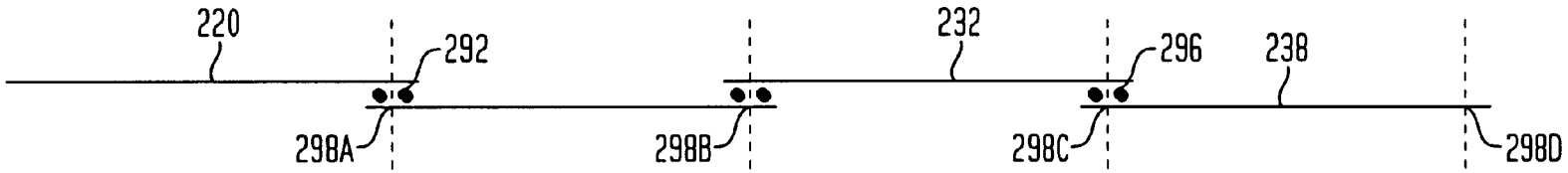
FIG. 12 shows a cross sectional view of the subassembly of FIG. 1 during a further stage of the assembly process.

Referring to FIG. 12, perforations are then formed that extend through the strips where the strips are joined together. In certain preferred embodiments, a perforating wheel (not shown) is used to form a first perforation 298A extending between the adhesive 292 joining the second end 224 of the first sheer strip 220 and the first edge 228 of the first opaque strip 226. A second perforation 298B is formed between the two beads of adhesive 294 adhering the first edge 234 of the second sheer strip 232 and the second edge 230 of the first opaque strip 226. A third perforation 298C is formed between the two beads of adhesive 296 adhering the second edge 236 of the second sheer strip 232 and the first edge 240 of the second opaque strip 238. A fourth perforation 298D is formed at the second edge 242 of the second opaque strip 238. The perforations enable the respective sheer and opaque strips to flex and/or fold relative to one another so that the opaque members may hingedly move relative to the sheer members when the shade is operated.

Figure 13:
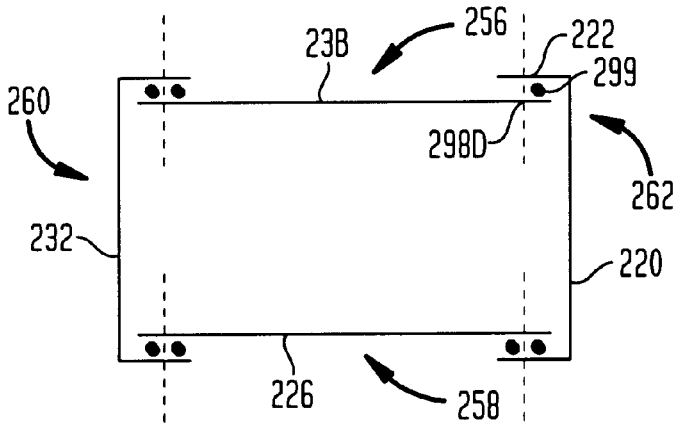
FIG. 13 shows a cross sectional view of the subassembly of FIG. 12 folded into a substantially rectangular cell, in accordance with certain preferred embodiments of the present invention.

Referring to FIG. 13, the connected sheer strips and opaque strips are then passed through a folding horn (FIG. 16A) that folds the respective strips into the configuration shown in FIG. 13. The strips are formed into a generally rectangular cell or tube whereby the second opaque strip 238 forms a top wall 256 of the cell, the first opaque strip 226 forms the bottom wall 258 of the cell, and the two sheer strips 232 and 220 form the respective side walls 260 and 262 of the cell, the side walls extending in substantially vertical directions between the top wall 256 and the bottom wall 258. The folding horn (FIG. 16A) also includes a trimming element that trims the first edge 222 of the first sheer strip 220 so that the first edge does not overlie the perforation 298D formed in the second edge 242 of the second opaque strip 238. The trimmed first edge 222 of the first sheer strip 220 is thus adhered to the second edge 242 of the second opaque strip 238 using only one bead of adhesive 299. The folded rectangular tube is then collapsed by forming creases or folds in the side walls 260 and 262 as shown above in FIG. 5A. The creases may be formed by fingers that engage the side walls as the tube moves through the folding horn.

Figure 14:
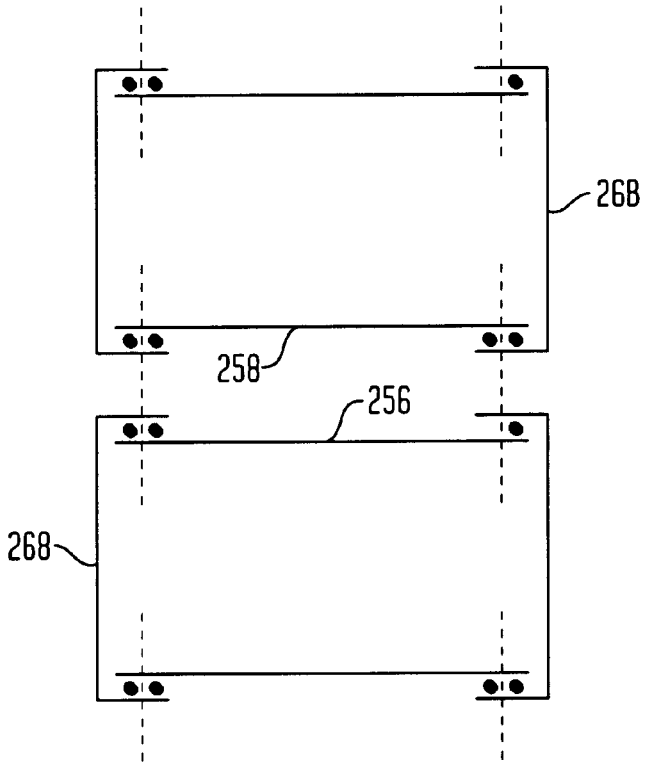
FIG. 14 shows a cross sectional view of a method of stacking two or more cells atop one another, in accordance with certain preferred embodiments of the present invention.

Referring to FIG. 14, the tubes 268 formed in the tube forming machine are then sent downstream to a stacking and bonding machine wherein a plurality of tubes formed are stacked atop one another, bonded and trimmed. As shown in FIG. 14, the tubes are stacked so that the bottom wall 258 of an upper tube is opposed by the top wall 256 of a lower tube. An adhesive material may be provided between the confronting bottom wall and top wall to adhere the adjacent tubes together. In one embodiment, the adhesive is applied completely across the opposing faces of the bottom wall and the top wall. However, in other embodiments the adhesive may only be provided in the corners or edges of the confronting tubes.

Figure 15A:
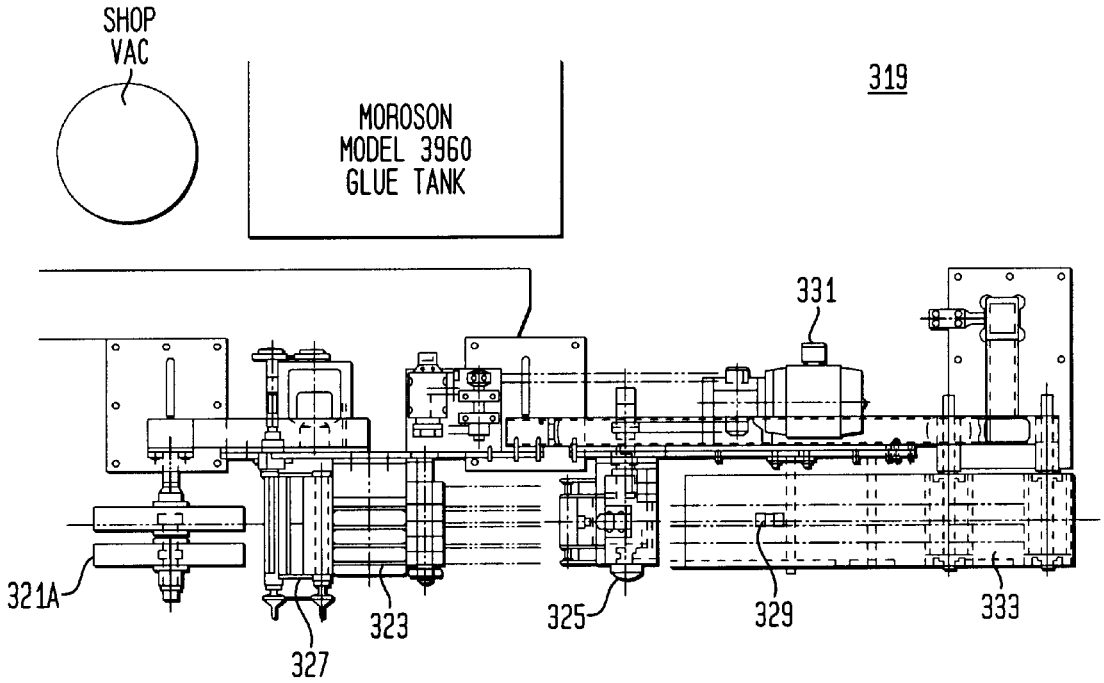
FIG. 15A shows a top view of a tube-forming machine, in accordance with certain preferred embodiments of the present invention.

FIGS. 15A–16C show a tube folding machine 319 in accordance with certain preferred embodiments of the present invention. Referring to FIGS. 15A and 15B, the tube forming machine includes two unwind stands 321A and 321B. A first unwind stand 321A carries two webs of sheer or opaque material and a second unwind stand 321B, positioned below the first unwind stand, carries two additional webs of sheer or opaque material. The webs of material provide the sheer and opaque strips used to form the cells described above. The webs of strip material are pulled across a stationery support surface 323 by a pulling mechanism 325. The machine also includes a trimmer 327 for cutting the strips of sheer and opaque material after the material has been configured in a side-by-side arrangement (FIG. 11) atop the stationery support surface 323.

Figure 15B:
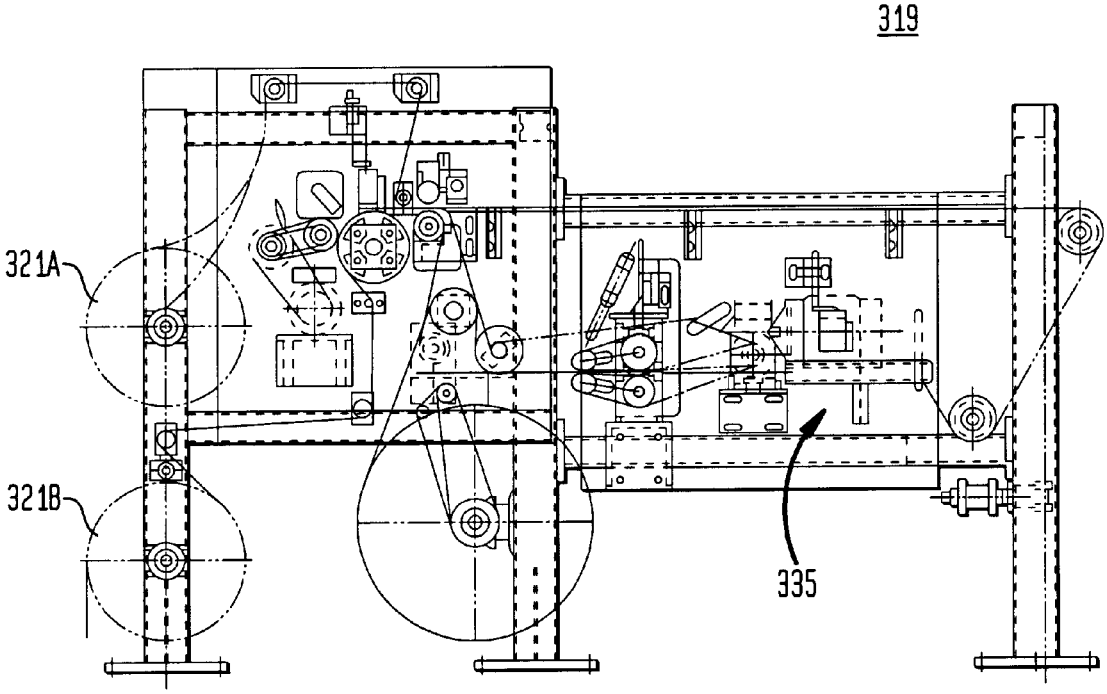
FIG. 15B shows a side view of the tube-forming machine shown in FIG. 15A including a folding horn.
Figure 18:
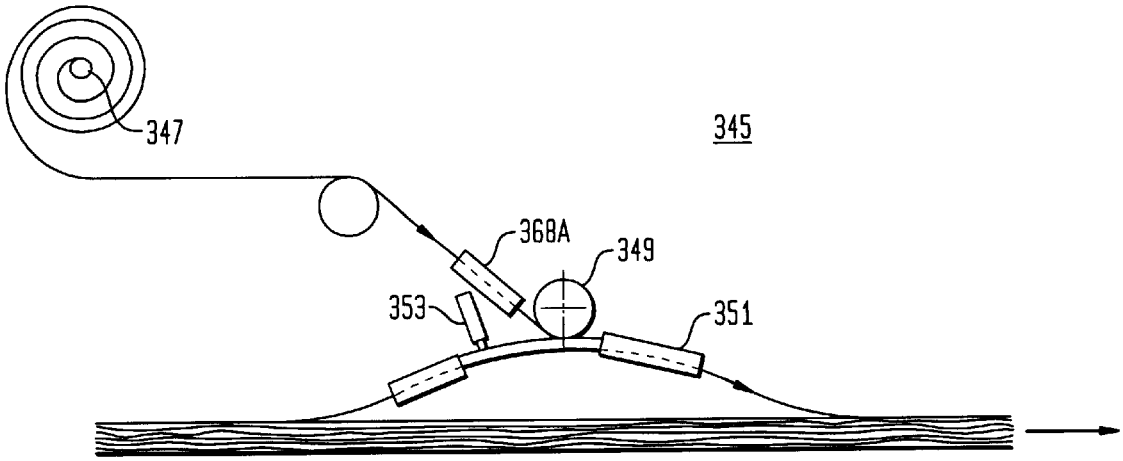
FIG. 18 shows a schematic view of a tube stacking element, in accordance with certain preferred embodiments of the present invention.
Figure 19:
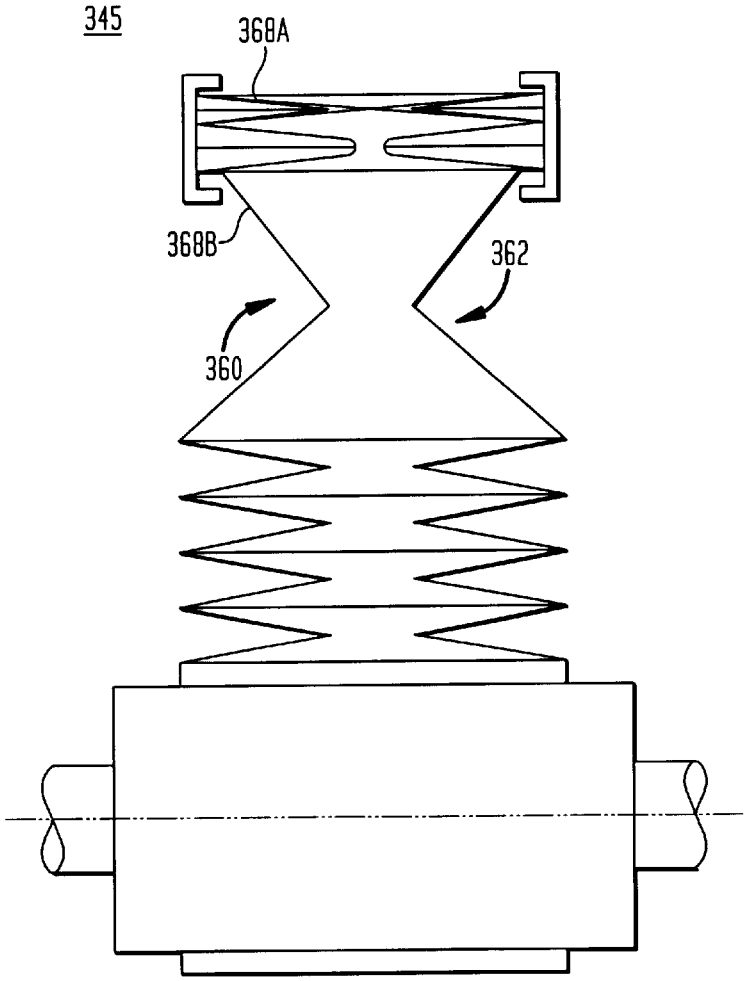
FIG. 19 shows an end view of the tube stacker shown in FIG. 18.

FIG. 15B is a side view of the tube forming machine 319 shown in FIG. 15A. The tube forming machine 319 includes a folding horn 335 which folds the two sheer strips and the two opaque strips into the substantially rectangular shaped tube described above. After the strips have been folded into a tube, the folding horn 335 collapses the side walls of the tube and collects the tube on tube roller (not shown). The tubes are then forwarded to a stacking machine (FIGS. 17–19).

Figure 16A:
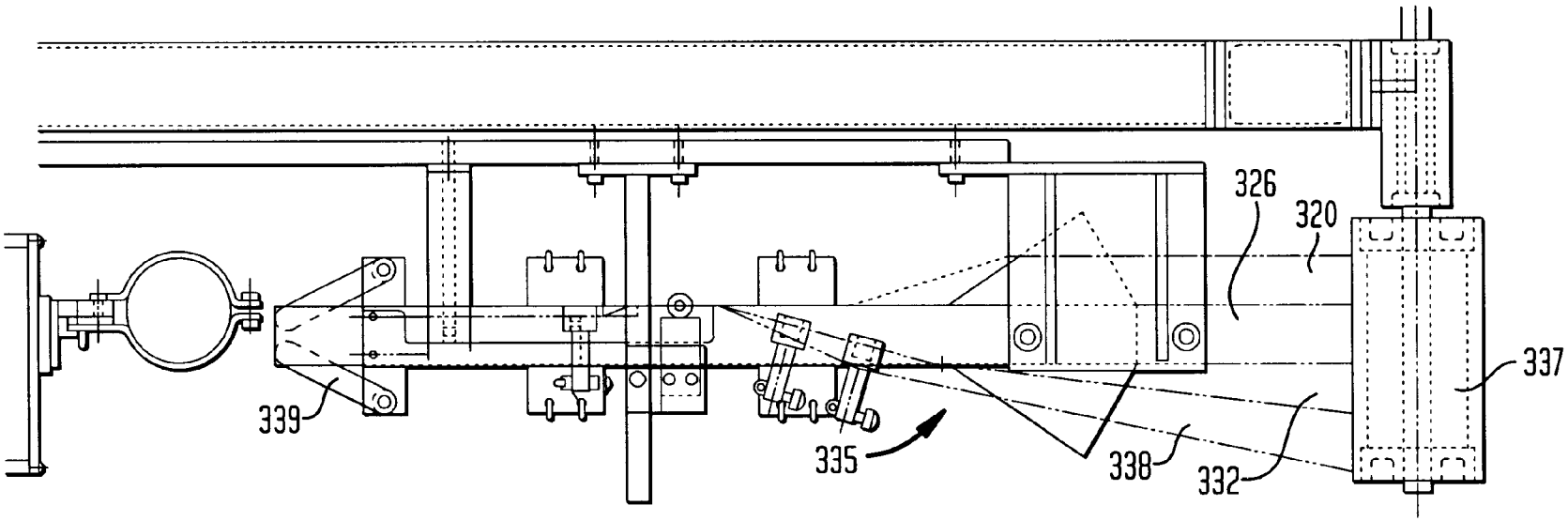
FIG. 16A shows a top view of the folding horn shown in FIG. 15, in accordance with certain preferred embodiments of the present invention.
Figure 16B:
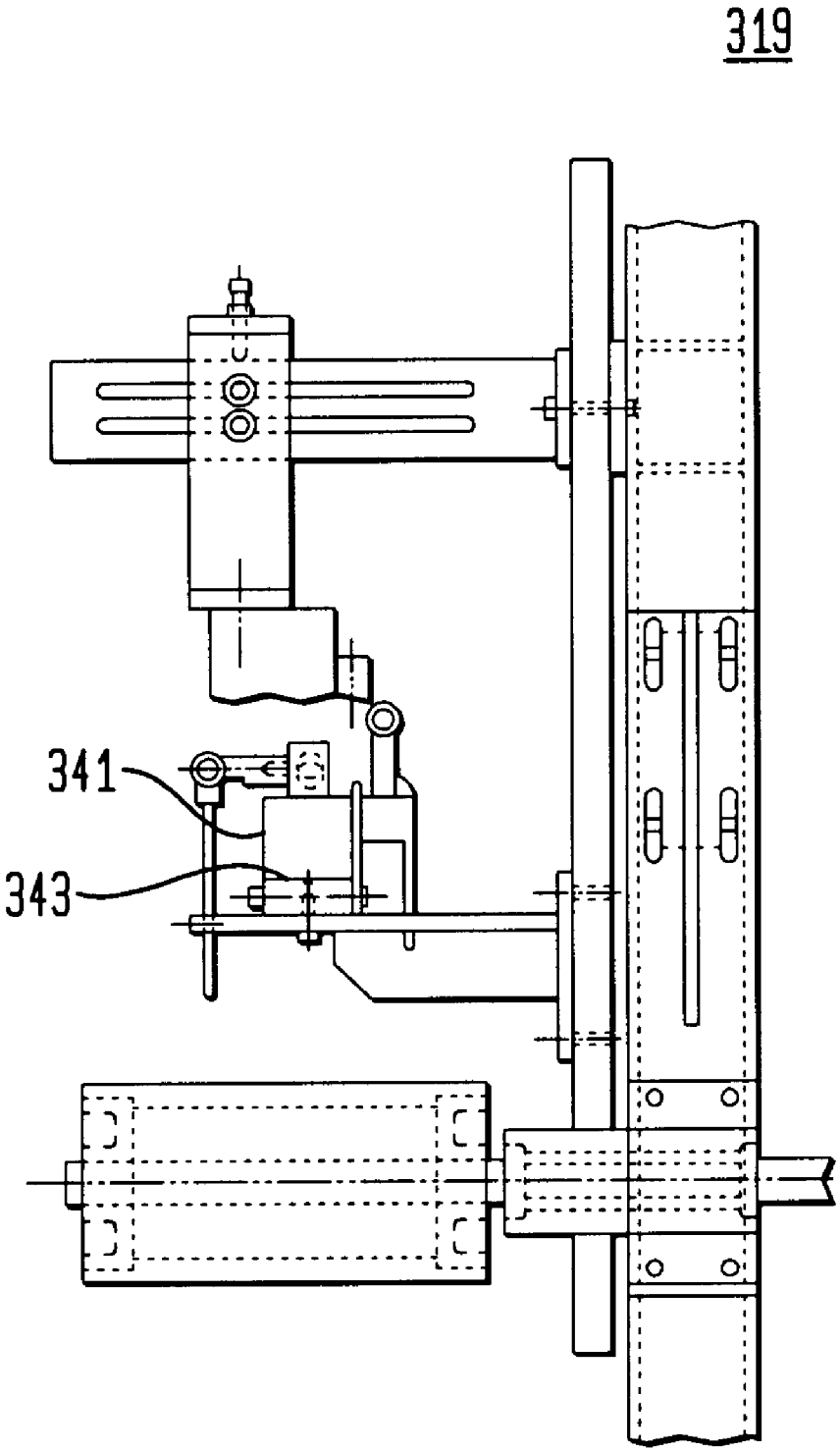
FIG. 16B shows an end view of the folding horn shown in FIG. 16A taken along line XVIB—XVIB of FIG. 16A.

FIGS. 16A through 16C show the folding horn for folding the adhered strips of sheer and opaque material into a cell or tube. In the folding horn embodiment shown in FIG. 16A, the adhered strips 320, 326, 332 and 338 move from right to left. As the material moves from right to left, the folding horn folds the material to form the rectangular shaped tube described above. After the strips have been folded into a rectangular shaped tube, fingers 339 form creases in the side walls of the tube for enabling the tube to move between a collapsed position and an expanded position.

FIG. 16B shows an upstream end view of the folding horn 319. The folding horn includes an inner guide 341 and an outer guide 343 for folding the strips of material into a substantially rectangular shape.

Figure 17:
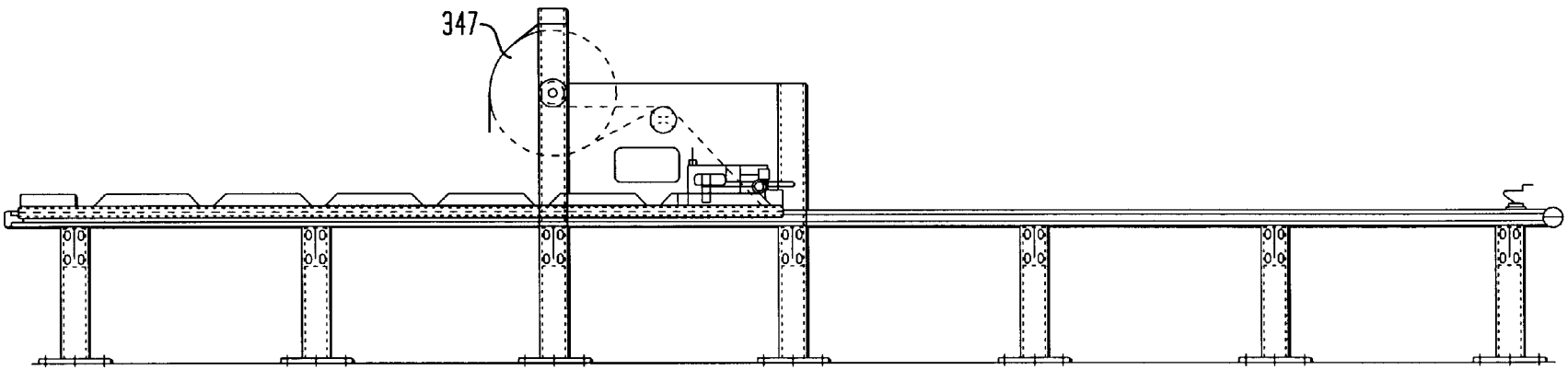
FIG. 17 shows a side view of a tube stacker, in accordance with certain preferred embodiments of the present invention.

FIG. 17 shows a tube stacker 345, in accordance with certain preferred embodiments of the present invention. The tube stacker 345 receives an incoming tube from roll 347 and adheres the incoming tube to the uppermost tube of a stack of tubes that have previously been adhered together.

FIG. 18 shows a schematic view of a tube stacker, in accordance with one preferred embodiment of the present invention. The stacker 345 includes an input roll 347 that contains the incoming tube recently formed in the tube forming machine. The incoming tube 368A (in a collapsed state) is guided over an idler roll and into a registration guide 351 that guides the incoming tube 368A into engagement with the top tube 368B of the stack. The guide remains stationary and the stack reciprocates back and forth between a start position and an end position. The registration guide captures an upper end of the uppermost tube 368B when the stack is in the start position and brings it into engagement with the incoming tube 368A. The stacking element 345 also includes an adhesive applicator 353 for applying an adhesive to the top wall of the uppermost tube. The nip roller 349 presses the incoming tube onto the top wall of the top tube of the stack. The stacking element also preferably includes a trimming device upstream of the nip roller 349 to cut the incoming tube to a predetermined length. The predetermined length preferably matches the length of the tubes in the stack.

FIG. 19 shows a right side view of the stacking element shown in FIG. 18. As shown therein, the stack of tubes is in a collapsed position with the side walls 360 and 362 of the tubes folded inwardly. The registration guide 351 captures the uppermost tube 368B of the stack and moves it into engagement with incoming tube 368A. An adhesive between the incoming tube 368A and the top wall of the uppermost tube 368B adheres the tubes together.

Although the invention herein has been described with reference to particular embodiments, it is to be understood that these embodiments are merely illustrative of the principles and applications of the present invention and that numerous modifications may be made to the illustrative embodiments without departing from the spirit and scope of the present invention as defined by the appended claims.

What is claimed is:

1. A window covering comprising a plurality of cells attached one atop the other, each said cell comprising:

a substantially opaque top strip at the top of said cell;

a substantially opaque bottom strip at the bottom of said cell;

a front sheer strip extending vertically at a front of said window covering having an upper end folded inwardly toward a front edge of said top strip and a lower end folded inwardly toward a front edge of said bottom strip;

a rear sheer strip extending vertically at a rear of said window covering having an upper end folded inwardly toward a rear edge of the top strip and a lower end folded inwardly toward a rear edge of the second strip;

adhesive material connecting the end portions of said front and rear sheer strips to adjacent ends of said top and bottom strips to form a generally rectangular-shaped loop, wherein said plurality of cells are stacked one atop the other to form said window covering with the bottom strip of a first cell abutting the top strip of a second cell directly below said first cell;

a head rail assembly attached to an uppermost cell of said plurality of cells;

a bottom rail assembly attached to a lowermost cell of said plurality of cells;

one or more lift cords connected to the head rail and the bottom rail for raising and lowering one of the head rail and bottom rail assemblies relative to the other of the head rail and bottom rail assemblies; and a layer of fabric positioned between each said cell and extending toward a rear side of said window covering, wherein each said rearwardly extending layer of fabric includes an aperture through which said one or more lift cords pass.

2. The window covering as claimed in claim 1, wherein the ends of the front and rear sheer strips overlap with the ends of the opaque strips.

3. The window covering as claimed in claim 2, wherein the adhesive is disposed between the overlapped ends of the front and rear sheer strips and the opaque strips.

4. The window covering as claimed in claim 1, wherein said substantially opaque top and bottom strips are adapted for at least partially impeding the flow of light through said cell and said front and rear sheer strips are made from fabric adapted to admit substantial amounts of light through said cell.

5. The window covering as claimed in claim 4, further comprising an operating element in contact with said cells for causing relative vertical movement of said front and rear sheer strips, wherein relative vertical movement between the front and rear sheer strips causes said substantially opaque top and bottom strips to rotate between a first substantially horizontal position and a second non-horizontal position.

6. The window covering as claimed in claim 5, wherein said substantially opaque top and bottom strips in the first substantially horizontal position allow light to flow between the front and rear sheer strips and through said window covering.

7. The window covering as claimed in claim 5, wherein said substantially opaque top and bottom strips in the second non-horizontal position at least partially obstruct the light flowing between said front and rear sheer strips and through said window covering.

8. The window covering as claimed in claim 1, wherein adjacent cells of said window covering are connected together at the end portions of said front and rear sheer strips.

9. The window covering as claimed in claim 8, wherein said adjacent cells are connected together by adhesive beads positioned proximate the end portions of said front and rear sheer strips.

10. The window covering as claimed in claim 1, wherein each said top and bottom strip has at least one opening through which said one or more lift cords pass.

11. The window covering as claimed in claim 1, wherein said one or more lift cords pass through the adhesive connecting the ends of the sheer strips and the top and bottom strips.

12. The window covering as claimed in claim 1, wherein the front and rear sheer strips of each said cell include at least one crease for enabling said cell to move between a collapsed position and an expanded position.

13. The window covering as claimed in claim 12, wherein the front sheer strip has at least one crease and the rear sheer strip has at least one crease.

14. The window covering as claimed in claim 13, wherein the creases in the front and rear sheer strips are directed inwardly toward one another.

15. The window covering as claimed in claim 13, wherein the creases in the front and rear sheer strips are directed outwardly away from one another.

16. The window covering as claimed in claim 1, wherein said top and bottom strips are made from flexible fabric.

17. The window covering as claimed in claim 1, wherein said front and rear sheer strips are made from flexible fabric.

18. A light control window covering comprising a plurality of cells attached one atop the other, each said cell comprising:

a substantially opaque top strip at the top of said cell;

a substantially opaque bottom strip at the bottom of said cell;

a substantially transparent front sheer member extending vertically at a front of said window covering having an upper end folded inwardly toward a front edge of said top strip and a lower end folded inwardly toward a front edge of said bottom strip;

a substantially transparent rear sheer member extending vertically at a rear of said window covering having an upper end folded inwardly toward a rear edge of the top strip and a lower end folded inwardly toward a rear edge of the bottom strip;

said front and rear sheer members having end portions being flexibly connected to adjacent ends of said top and bottom strips to form a generally rectangular-shaped loop;

an adhesive material comprising thin strips of material connecting said sheer members and said top and bottom strips to provide a flexible hinge between said sheer members and said top and bottom strips, wherein said plurality of cells are stacked one atop the other to form said window covering with the bottom strip of a first cell abutting the top strip of a second cell directly below said first cell; and an operating element in contact with said cells for causing relative vertical movement of said front and rear sheer members, wherein relative vertical movement between the front and rear sheer members causes said top and bottom strips to rotate between a first substantially horizontal position which allows light to flow between said sheer members and a second position in which said top and bottom strips at least partially obstruct the flow of light through said sheer members.

19. The light control window covering according to claim 18, wherein the operating element includes one or more lifting cords for lifting a lowermost cell of said window covering to thereby collapse one or more of said cells.

20. The light control window covering according to claim 18, wherein said cells are adhered to each other by beads of adhesive positioned proximate the end portions of said sheer members.

21. The light control window covering according to claim 18, wherein said substantially opaque top and bottom strips are made from soft fabric.

22. The light control window covering according to claim 18, wherein said front and rear sheer members are made from soft fabric.

23. A window covering comprising a plurality of cells attached one atop the other, each said cell comprising:

a substantially opaque top strip at the top of said cell;

a substantially opaque bottom strip at the bottom of said cell;

a substantially sheer front strip extending vertically at a front of said window covering having an upper end folded inwardly toward a front edge of said top strip and a lower end folded inwardly toward a front edge of said bottom strip;

a substantially sheer rear strip extending vertically at a rear of said window covering having an upper end folded inwardly toward a rear edge of the top strip and a lower end folded inwardly toward a rear edge of the second strip;

adhesive material connecting the end portions of said front and rear strips to adjacent ends of said top and bottom strips to form a generally rectangular-shaped loop, wherein said plurality of cells are stacked one atop the other to form said window covering with the bottom strip of a first cell abutting the top strip of a second cell directly below said first cell;

a head rail assembly attached to an uppermost cell of said plurality of cells;

a bottom rail assembly attached to a lowermost cell of said plurality of cells;

one or more lift cords connected to the head rail and the bottom rail for raising and lowering one of the head rail and bottom rail assemblies relative to the other of the head rail and bottom rail assemblies; and a layer of fabric positioned between each said cell and extending toward a rear side of said window covering, wherein each said rearwardly extending layer of fabric includes an aperture through which said one or more lift cords pass.

24. The window covering as claimed in claim 23, wherein adjacent cells of said window covering are connected together at the end portions of said front and rear strips.

25. The window covering as claimed in claim 24, wherein said adjacent cells are connected together by adhesive beads positioned proximate the end portions of said front and rear strips.

26. The window covering as claimed in claim 23, wherein each said top and bottom strip has at least one opening through which said one or more lift cords pass.

27. The window covering as claimed in claim 23, wherein said one or more lift cords pass through the adhesive connecting the ends of the front and rear strips and the top and bottom strips.

28. The window covering as claimed in claim 23, wherein the front and rear strips of each said cell include at least one crease for enabling said cell to repeatedly collapse and expand.

29. The window covering as claimed in claim 28, wherein the front strip has at least one crease and the rear strip has at least one crease.

30. The window covering as claimed in claim 29, wherein the creases in the front and rear strips are directed inwardly toward one another.

31. The window covering as claimed in claim 29, wherein the creases in the front and rear strips are directed outwardly away from one another.

32. The window covering as claimed in claim 23, wherein said top, bottom, front and rear strips are made from flexible fabric.

* * * * *